US012031307B2

(12) United States Patent
Malpede

(10) Patent No.: US 12,031,307 B2
(45) Date of Patent: Jul. 9, 2024

(54) SOAP DISPENSER

(71) Applicant: Nicholas Scott Malpede, McLean, VA (US)

(72) Inventor: Nicholas Scott Malpede, McLean, VA (US)

( * ) Notice: Subject to any disclaimer, the term of this patent is extended or adjusted under 35 U.S.C. 154(b) by 231 days.

(21) Appl. No.: 17/848,690

(22) Filed: Jun. 24, 2022

(65) Prior Publication Data

US 2023/0077738 A1 Mar. 16, 2023

Related U.S. Application Data

(60) Provisional application No. 63/243,870, filed on Sep. 14, 2021.

(51) Int. Cl.
*E03C 1/046* (2006.01)

(52) U.S. Cl.
CPC ..... *E03C 1/0465* (2013.01)

(58) Field of Classification Search
CPC ... E03C 1/0465; B65D 47/243; B65D 47/247; B65D 90/58; B65D 90/587
See application file for complete search history.

(56) References Cited

U.S. PATENT DOCUMENTS

| | | | | |
|---|---|---|---|---|
| 1,250,089 | A | 12/1917 | Campbell | |
| 3,581,996 | A * | 6/1971 | Boyer | B05B 7/2462 292/259 R |
| 5,274,858 | A * | 1/1994 | Berry | A47K 5/08 4/605 |
| 9,096,995 | B1 | 8/2015 | Al-Qaneei | |
| 2012/0223159 | A1 | 9/2012 | Gregory | |
| 2012/0255623 | A1* | 10/2012 | Bell | C02F 1/003 137/268 |
| 2022/0379321 | A1* | 12/2022 | Edwards | B05B 1/18 |
| 2023/0016400 | A1* | 1/2023 | Wales | E03C 1/046 |

FOREIGN PATENT DOCUMENTS

| | | | |
|---|---|---|---|
| CN | 201324181 | Y | 10/2009 |
| CN | 112842111 | A | 5/2021 |
| CN | 213572196 | U | 6/2021 |

* cited by examiner

*Primary Examiner* — Donnell A Long
(74) *Attorney, Agent, or Firm* — VENABLE LLP

(57) ABSTRACT

A soap dispenser includes a housing including an outer sleeve and an inner sleeve, and a soap container having an exterior wall and an interior wall and configured to slide axially relative to the housing, with the interior wall having openings for soap. In a first position the soap container is housed within the housing and the interior wall is located within the inner sleeve, and in a second position the soap container is axially extended from the housing and the exterior wall is axially extended from the inner sleeve.

20 Claims, 4 Drawing Sheets

SOAP DISPENSER

FIELD OF THE INVENTION

The present invention relates generally to a soap dispenser, and more particularly to a faucet mounted soap dispenser for dispensing soap with running water.

BACKGROUND OF THE INVENTION

Soap dispensers for dispensing soap, such as for use in a kitchen or bathroom, are well known. In bathroom use, for example, a soap dispenser contains liquid soap for washing a user's hands. In a kitchen, both hand soap and dish washing soap are typically used.

Soap, in its liquid form, can be dispensed from its original store-bought container or, alternatively, provided in a dispenser specifically designed to dispense soap through a pump and relying on air suction. In both examples, it requires a first step of applying soap to the item (e.g., hands or dishes) to be cleaned and then a second step of applying water.

SUMMARY OF THE INVENTION

It is an object of the invention to provide a soap dispenser designed to be mounted on a faucet for dispensing soap in combination with water in one operational mode or alternatively dispensing only water in a second operational mode.

In accordance with one aspect of the invention, a soap dispenser comprises a housing including an outer sleeve and an inner sleeve, and a soap container having an exterior wall and an interior wall and configured to slide axially relative to the housing, with the interior wall having openings for soap. In a first position the soap container is housed within the housing and the interior wall is located within the inner sleeve, and in a second position the soap container is axially extended from the housing and the interior wall is axially extended from the inner sleeve.

In accordance with another aspect of the invention, a soap dispenser comprises a housing including an outer sleeve and an inner sleeve, and a soap container having an exterior wall and an interior wall and configured to move relative to the housing, with the interior wall having openings for soap. In a first position the soap container is positioned to block soap from being released, and in a second position the soap container is positioned to allow soap to be released in a water stream.

In accordance with yet another aspect of the invention, a soap dispenser comprises a housing including an outer sleeve and an inner sleeve, with the housing being secured to an outlet for dispensing water, and a soap container having an exterior wall and an interior wall and configured to move relative to the housing, with the interior wall having openings for soap. In a first position the soap container is positioned to block soap from being released, and in a second position the soap container is positioned to allow soap to be released in a water stream.

These and other aspects of the invention will become apparent from the following disclosure.

DETAILED DESCRIPTION OF THE PREFERRED EMBODIMENTS

Figure 1:
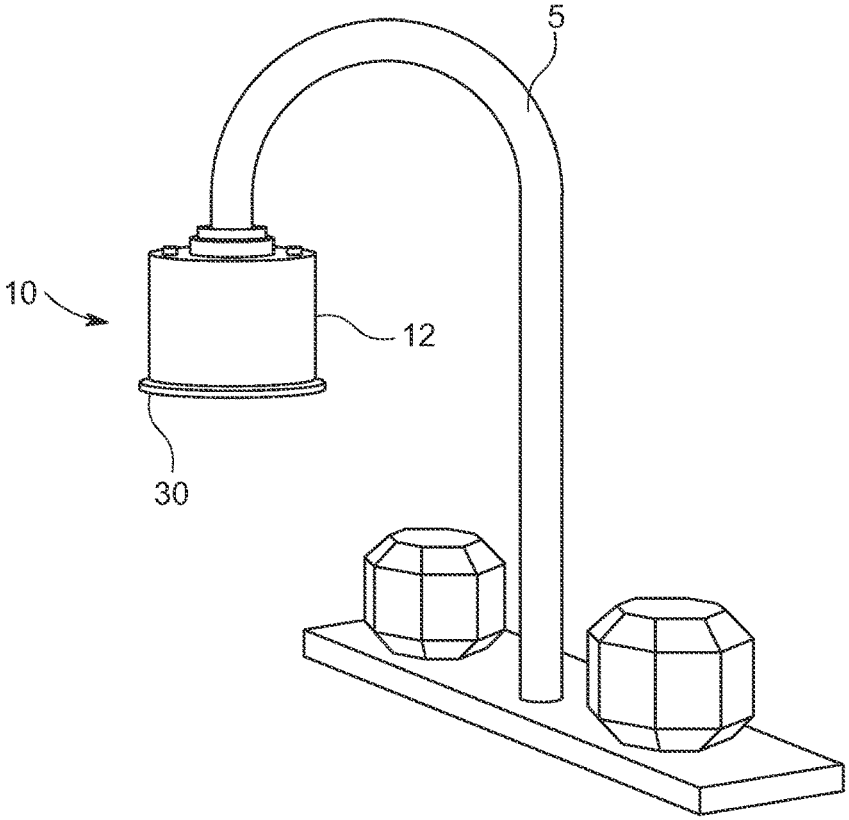
FIG. 1 is a perspective view of a soap dispenser, in its closed position, attached to a water faucet, in accordance with a first embodiment of the invention.

FIG. 1 illustrates a first embodiment of the invention, showing a soap dispenser 10 attached to a spout 5 of a faucet. The soap dispenser, shown in its closed position, includes a housing 12, and a lower, outer rim 30 of a soap container (discussed below), which in this view is recessed within the housing in a closed position. In this position, in a manner described in detail below, water flows through the soap dispenser but soap is not dispensed. The soap dispenser can be attached to a standard spout 5 of a faucet in a conventional manner such as by screw threads.

Figure 2:
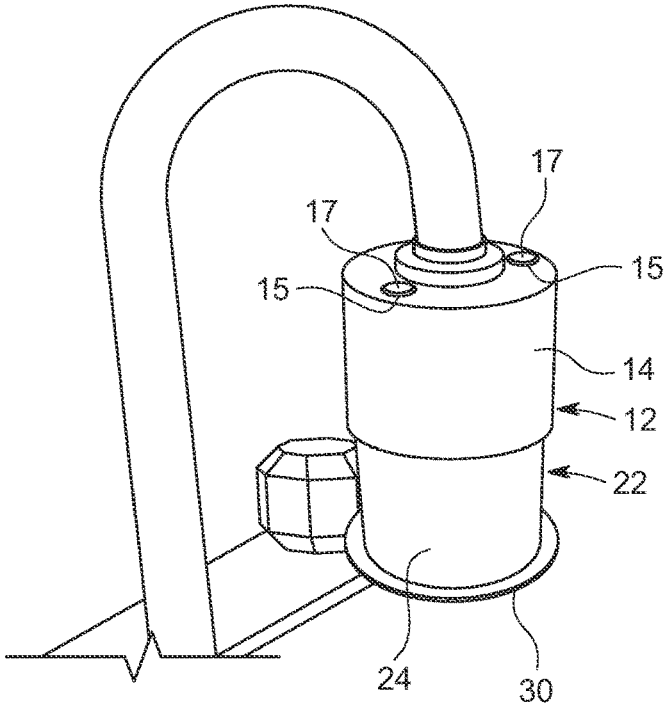
FIG. 2 is a perspective view of the soap dispenser, in its open position, attached to the water faucet.

FIG. 2 shows the soap dispenser in an open position, which allows for soap to be dispensed along with the water. The housing 12 includes an outer sleeve 14 and holes (openings) 15 in its top surface for filling soap into a soap container 22. Plugs 17 are provided for closing the holes. In this open position the soap container is axially extended from the housing, allowing for the soap to be dispensed in a manner described below.

The soap container 22 in this view shows an exterior wall 24 and the lower, outer rim 30. Both the housing and the soap dispenser are cylindrical in shape in this embodiment, although alternative shapes can be employed without departed from the scope of the invention.

Figure 3:
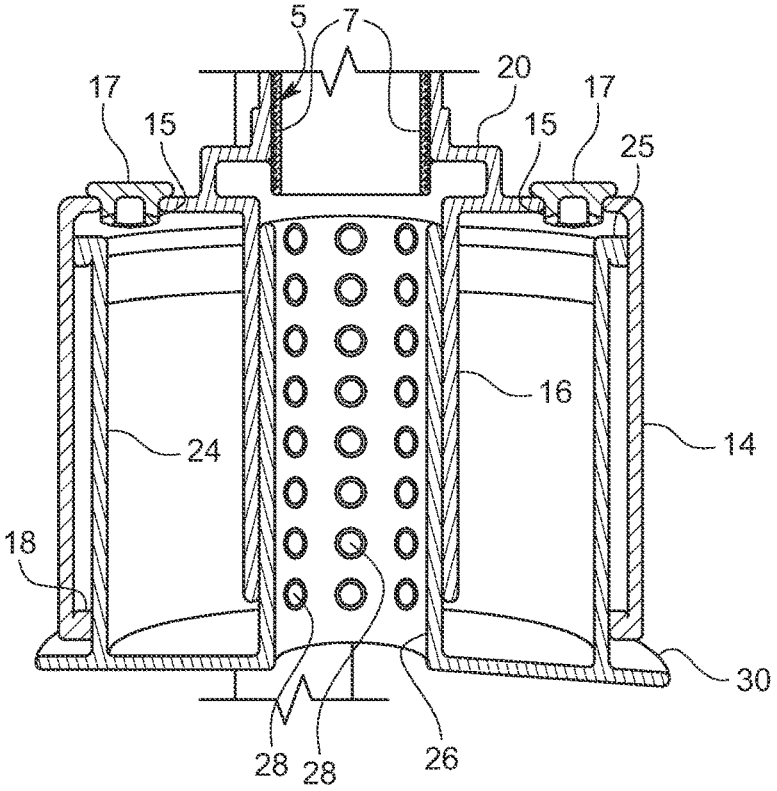
FIG. 3 is a cross-sectional view of the soap dispenser in the closed position.
Figure 4:
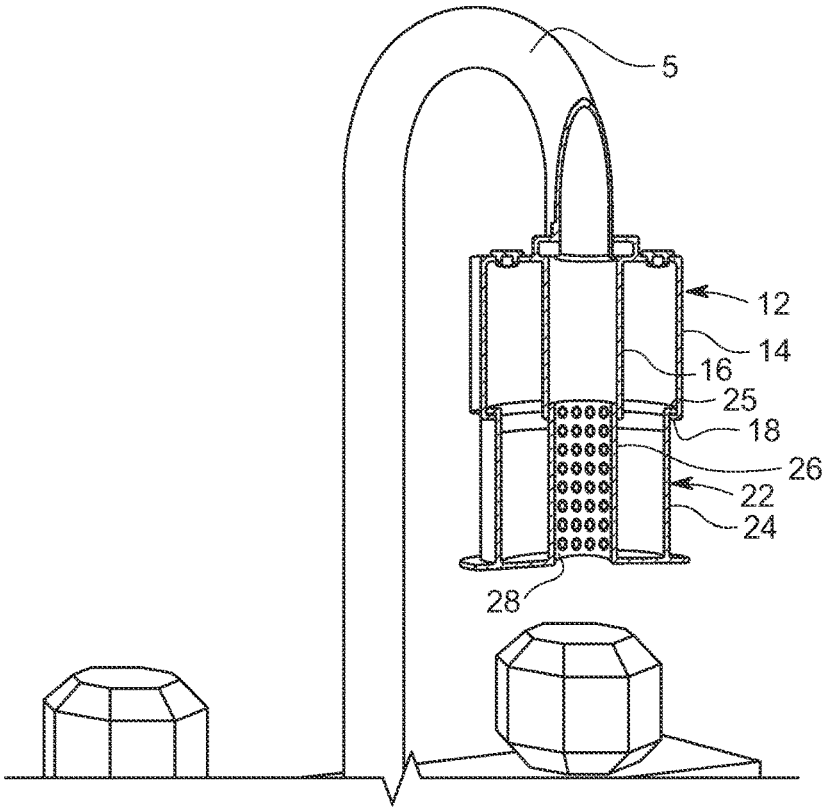
FIG. 4 is a perspective view, partly in cross sectional, of the soap dispenser in the open position.
Figure 5:
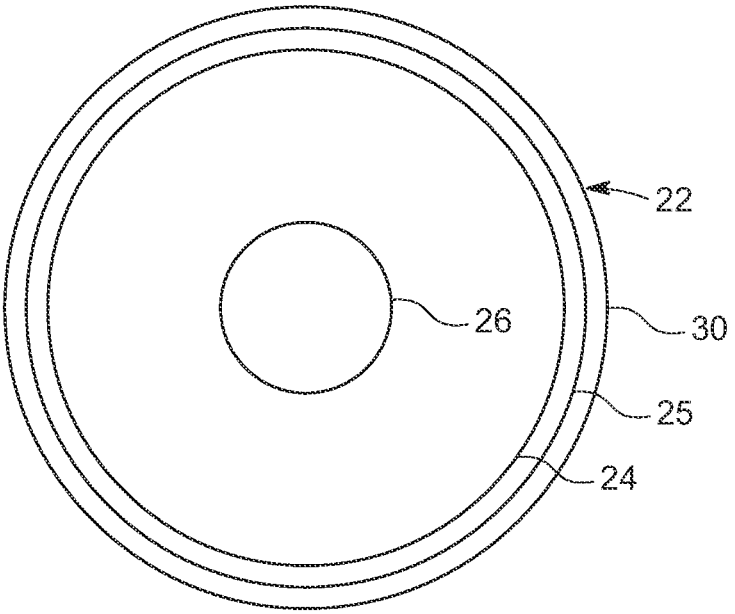
FIG. 5 is a top plan view of an isolated soap container in accordance with the first embodiment of the invention.

Integral parts of the soap dispenser are illustrated in FIGS. 3-5. The entire soap dispenser 10 is stationarily mounted to the spout 5 by a collar 20 of the housing 12 and secured via a threaded attachment 7. The plugs 17 are removable to allow soap to flow through the holes, or openings, 15, to fill an interior compartment of the soap container 22. The housing includes an outer sleeve 14 and a concentric inner sleeve 16.

The soap container includes an outer cylindrical wall 24 having an upper outer rim 25 and a lower outer rim 30. An inner cylindrical wall 26 includes a plurality of soap holes 28 through which the soap flows from the soap container. The soap container is designed to slide axially with respect to the housing 12, which is stationary in this embodiment, to open and close access to the soap holes.

In the position shown in FIG. 3, the soap dispenser is in the closed operational mode, with the inner sleeve 16 axially aligned and encasing the interior wall 26 of the soap container. In this position, which is maintained by frictional forces between the inner sleeve and the interior wall, and the respective rims and the outer wall and the outer sleeve, the soap holes 28 are closed off from the soap in the soap container by the inner sleeve. Consequently, when water is running through the faucet, only water, and not soap, will be dispensed.

In the open operation mode, shown in FIG. 4, the soap container 22 is axially lowered until the upper outer rim 25 of the soap container engages with the inner rim 18 of the housing. In this position, the interior wall 26 is free from the inner sleeve 16, allowing soap to flow through the soap holes 28 with the help of aspiration created by flowing water. As will also be appreciated, the soap container can be lowered fully as shown in FIG. 3 or can be less than fully extended to leave some holes 28 covered by the inner sleeve in order to regulate soap flow.

As illustrated, the inner cylindrical wall 26 slides in and out of contact with an interior surface of the inner sleeve 16. An alternative design with the cylindrical wall 26 sliding along the outside of the inner sleeve to open and close access to the holes 28 is also within the scope of this invention. In a further alternative, the soap container 12 can be attached to the faucet spout, and the housing can be configured to slide.

Figure 6:
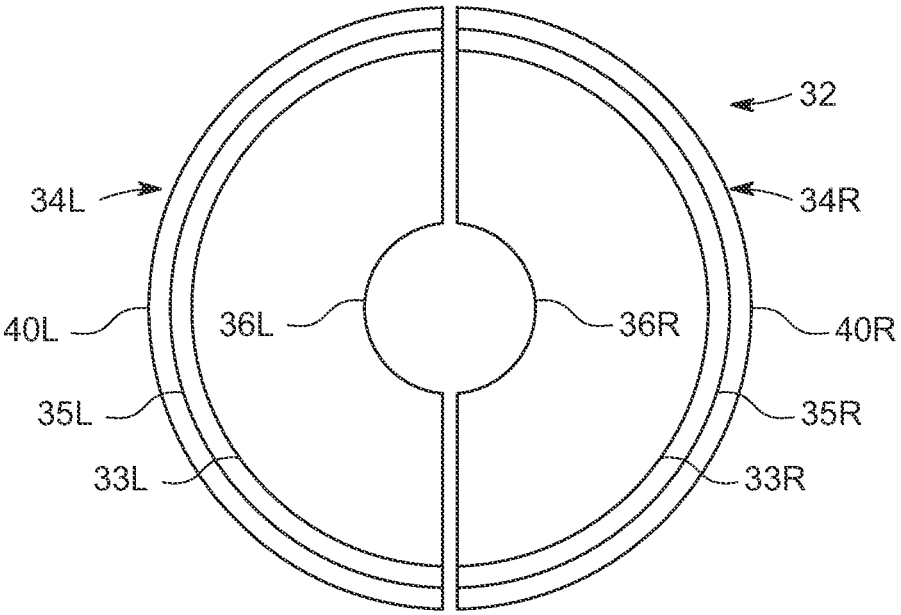
FIG. 6 is a top plan view of an isolated soap container in accordance with a second embodiment of the invention.
Figure 7:
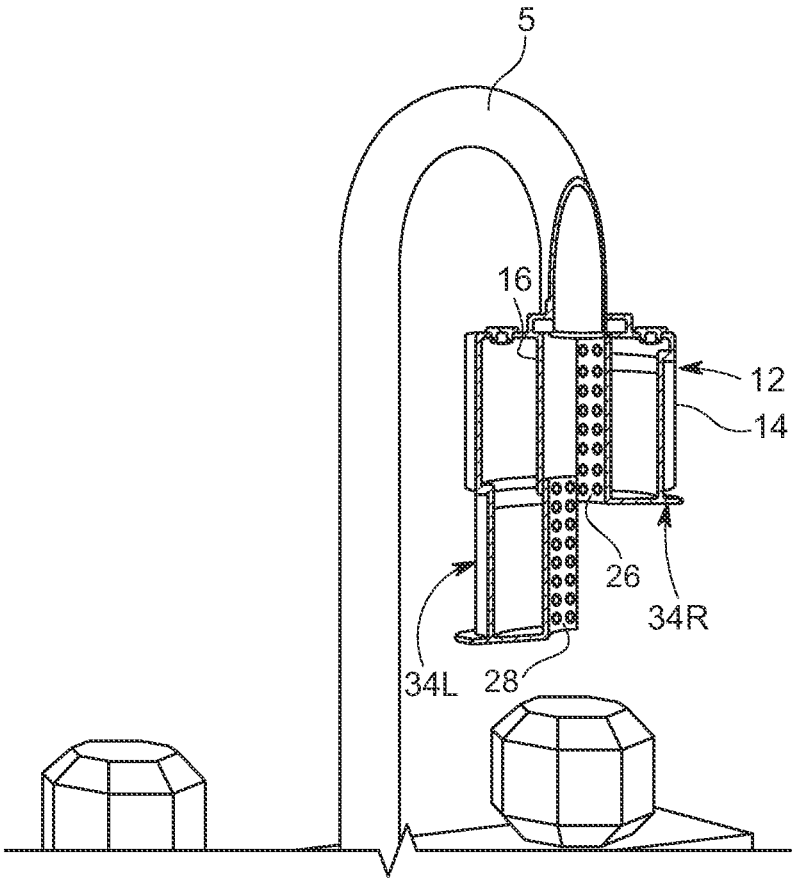
FIG. 7 is a perspective view, partly in cross-section, of the soap dispenser in its open position in accordance with the second embodiment.

An alternative embodiment is illustrated in FIGS. 6 and 7. In this design, a soap container is divided into two separate halves to allow for different soaps to be used. As described below, each separate soap container can independently slide axially with respect to the housing to expose openings to the soap. The housing in this modification is the same housing shown and disclosed above.

The soap container 32 in FIG. 6 is comprised of a right-side soap container 34R and a left-side soap container 34L. Each soap container includes a lower rim 40R and 40L, an outer wall 33R and 33L, and an upper outer rim 35R and 35L. Each soap container is generally semi-circular in shape to match the profile of the housing and includes an inner cylindrical half wall 36R and 36L.

In use, as illustrated in FIG. 7, the left side soap container 34 L is axially lowered from the housing. This frees the openings 28 in the left side soap container from contact with the inner sleeve 16 and allows soap contained in the left side soap container to be dispensed through the openings and mix with the running water. On the right side, the soap container 34R is in its closed position, with the openings sealed by the inner sleeve. In this position, soap from the right-side soap container will not be dispensed. At the user's discretion, the soap container can operate to lower either side depending on what soap is preferred to be dispensed.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A soap dispenser, comprising:

a housing including an outer sleeve and an inner sleeve; and a soap container (22) having an exterior wall (24) and an interior wall (26) and configured to slide axially relative to said housing, with the interior wall having openings for soap, wherein in a first position said soap container is housed within said housing and said interior wall is located within said inner sleeve, and in a second position said soap container is axially extended from said housing and said interior wall is axially extended from said inner sleeve.

2. A soap dispenser according to claim 1, wherein said housing includes a concentric collar for attaching to a faucet.

3. A soap dispenser according to claim 1, wherein said housing and said soap container are concentrically aligned.

4. A soap dispenser according to claim 1, wherein said housing includes a rim at its lower end for engaging said soap container.

5. A soap dispenser according to claim 4, wherein said soap container includes a rim at its upper end for engaging said housing rim.

6. A soap dispenser according to claim 1, wherein said soap container includes more than one compartment for containing soap.

7. A soap dispenser according to claim 1, wherein said housing includes an opening in a top surface for receiving soap.

8. A soap dispenser, comprising:

a housing including an outer sleeve and an inner sleeve; and a soap container having an exterior wall and an interior wall and configured to move relative to said housing, with the interior wall having openings for soap, wherein in a first position said soap container is positioned to block soap from being released, and in a second position said soap container is positioned to allow soap to be released in a water stream.

9. A soap dispenser according to claim 8, wherein in the second position said soap container is axially extended from said housing.

10. A soap dispenser according to claim 8, wherein said housing includes a concentric collar for attaching to a faucet.

11. A soap dispenser according to claim 8, wherein said housing includes a rim at its lower end for engaging said soap container.

12. A soap dispenser according to claim 11, wherein said soap container includes a rim at its upper end for engaging said housing rim.

13. A soap dispenser according to claim 8, wherein said soap container includes more than one compartment for containing soap.

14. A soap dispenser according to claim 8, wherein said housing includes an opening in a top surface for receiving soap.

15. A soap dispenser, comprising:

a housing including an outer sleeve and an inner sleeve, with said housing being secured to an outlet for dispensing water; and a soap container having an exterior wall and an interior wall and configured to move relative to said housing, with the interior wall having openings for soap, wherein in a first position said soap container is positioned to block soap from being released, and in a second position said soap container is positioned to allow soap to be released in a water stream.

16. A soap dispenser according to claim 15, said soap container moves axially with respect to said housing.

17. A soap dispenser according to claim 15, wherein said soap container includes a plurality of compartments for containing soap.

18. A soap dispenser according to claim 15, wherein said soap container comprises individually moving compartments each capable of containing soap.

19. A soap dispenser according to claim 15, wherein said housing includes a rim at its lower end for engaging said soap container.

20. A soap dispenser according to claim 19, wherein said soap container includes a rim at tis upper end for engaging said housing rim.

* * * * *